United States Patent [19]

Blase et al.

[11] Patent Number: 4,477,537

[45] Date of Patent: Oct. 16, 1984

[54] METHOD FOR PRODUCING BURR-FREE BLANKS AND THE BLANKS PRODUCED THEREBY

[75] Inventors: Robert Blase; John G. Blase, both of Fairfield, Conn.

[73] Assignee: Blase Tool and Manufacturing Co., Inc., Stratford, Conn.

[21] Appl. No.: 422,357

[22] Filed: Sep. 23, 1982

[51] Int. Cl.[3] ..... B21D 28/16

[52] U.S. Cl. ..... 428/577; 428/687; 83/51; 83/55

[58] Field of Search ..... 428/577, 578, 579, 580, 428/581, 687; 83/50, 51, 55, 103, 862, 865

[56] References Cited

U.S. PATENT DOCUMENTS

| | | | |
|---|---|---|---|
| 3,724,305 | 4/1973 | Kondo | 83/55 |
| 3,878,746 | 4/1975 | Carmeli | 83/51 |
| 4,362,078 | 12/1982 | Ohnishi et al. | 83/50 |

*Primary Examiner*—L. Dewayne Rutledge
*Assistant Examiner*—Robert L. McDowell
*Attorney, Agent, or Firm*—Barry Kramer

[57] ABSTRACT

A method is provided for manufacturing a burr-free blank from an elongated sheet of flat metal stock comprising punching a first aperture in one surface of said metal stock, said first aperture extending only partially through said stock;

simultaneously forming the lower burnished land portion of said blank;

punching a second aperture in the opposite surface of said metal stock, coaxial with said first aperture, said second aperture extending only partially through said stock, said second aperture being smaller than said first aperture;

simultaneously forming the upper burnished land portion of said blank, causing the material of said stock to fracture between said burnished land portions and recovering said burr-free blank.

The resulting burr-free metal blank exhibits a shiny upper peripheral burnished land portion, a rough, fractured intermediate peripheral portion and a shiny lower peripheral burnished land portion, said lower land portion having a smaller circumference than said upper land portion.

10 Claims, 10 Drawing Figures

METHOD FOR PRODUCING BURR-FREE BLANKS AND THE BLANKS PRODUCED THEREBY

BACKGROUND OF THE INVENTION

1. Field Of The Invention

This invention relates to the metal working art, and more particularly, to a method for stamping blanks from flat metal stock and to the stamped blanks which have accuratelyformed burr-free, peripheral surfaces.

2. Description Of The Prior Art

In conventional stamping or blanking operations, there is ever present the tendency for the material adjacent the blank periphery to be drawn axially over a punch diameter so as to present an uneven edge or rough margin, commonly referred to as a "burr", formed during the blanking operation. Such blanks are not suitable for use where surface smoothness is especially desirable as, for example, where sliding surfaces are to be encountered or proper seating is important. This is true of articles produced by stamping from flat metal stock such as washers, bearing retainers, and the like. To this end, the present invention contemplates a method whereby burr-free blanks conforming with predetermined dimensional and surface contour standards can be produced successfully from a strip of flat metal stock.

There have been attempts heretofore to produce burr-free and smooth, peripheral surface blanks stamped from flat metal stock. However, the equipment utilized has either been expensive, impractical, or failed in its intended purpose.

For example, U.S. Pat. No. 2,674,780 issued to M. H. Nielsen recognizes the problem that in conventional stamping or blanking operations there is ever present the tendency for the material adjacent the blank periphery to be drawn axially so as to form a burr. In order to solve this problem, the patentee provides a method and apparatus wherein successive blanks punched from flat metal stock are pushed through a series of stacked dies provided with teeth of varying length about their inner periphery through which the cut metal is pushed to lap, burnish and sever any burrs on the outer surface of the cut blank.

U.S. Pat. No. 2,636,253 issued to C. A. Rees illustrates a tool and method for removing burrs extending into an interior opening in a piece of metal by subjecting the burr to cold working and ultimately breaking the burr from the blank by passing the blank about a tool having a plurality of successively larger diameters which contact the burr to cold work and remove it from the stock surrounding the interior opening of the blank.

Another method utilized by the prior art in an attempt to produce burr-free blanks is known as "fine-blanking". In this process, a blank is punched or stamped out of a piece of flat metal stock while the surrounding metal is compressed toward the punch to prevent the material from fracturing. However, while the resultant blank has shiny smooth edges throughout the length of its periphery, a burr is still formed adjacent one end of the peripheral edge as the metal material is drawn laterally and axially about the punch as the metal is pressed downwardly.

U.S. Pat. Nos. 1,476,706; 2,508,758; and 3,878,746, all disclose attempts at forming a burr-free blank by partially cutting a piece of stock from one side and then cutting the stock completely through from the opposite surface. While these patents suggest cutting the edge of a blank partially from each side and then causing an uncut portion intermediate the cut edges to fracture to sever the blank from the stock. Nevertheless, the punch and die configurations disclosed are such that when the lower punch cuts and severs the blank completely and pushes it out of the stock, an edge of the blank still can be drawn around the punch to form a burr. There is no recognition in these patents that the first cut opening must be larger than the second in order to assure that a controlled fracture occurs between the off-set cut edges, rather than a cut completely through the stock.

It has also been determined that a process which cuts along one edge, rather than off-set edges cannot achieve a true burr-free blank for the reason that the metal around the cut blank would shear, gall and tear up the blank edge as it was pushed from the stock. The use of a first cut, larger opening therefore, also enables the severed blank to be pushed freely from the metal stock without contact with the stock to reduce the possibility of having its edge snag to form a burr.

A different process is disclosed in U.S. Pat. No. 3,583,226. In this patent, a burr-free blank is formed by punching the metal stock from one surface, while simultaneously cutting the metal from its opposite surface. In lieu of cutting the stock completely through, a separate knockout member or ejector is used to fracture, rather than cut, the metal between its partially cut upper and lower portions to preclude the formation of a burr. While this procedure ostensibly will produce a burr-free article, the snagging of the blank on the surrounding metal still may occur and a complicated press and die arrangement utilizing a separate element is required, other than the die punches to sever the blank from the metal stock. Further, the metal fractured must be soft material only, so that the apparatus is effective.

The present method and apparatus overcomes the deficiencies noted in the prior art and also provides an inexpensive, yet highly successful method and apparatus to produce a truly burr-free stamped blank held to close tolerances.

SUMMARY OF THE INVENTION

In the present invention, a sheet of metal stock is initially subjected to contact with a punch located in a die mechanism carried by a vertical press. The punch is located within the press opposite a relatively stationary, second punch. The die mechanism surrounding the movable punch is adapted to move relative to the punch to make contact with a resiliently mounted, lower die mechanism surrounding the relatively stationary second punch. The first punch descends along with the press ram and die mechanism under a load to contact the metal stock to partially cut through one side of the stock from above. The load on the first punch is then relieved, but the die mechanism surrounding the punch continues to descend pressing the stock against the lower, stationary punch which cuts or severs the material from below, pushing it up and breaking or fracturing the stock intermediate its top and bottom surfaces to form a burr-free blank. Since the blank is broken or fractured from the stock intermediate its top and bottom surfaces, there is no chance for the blank material to be drawn axially about either the first or second punch to form a burr.

In accordance with the present invention, the upper punch is provided with a larger cut opening than the lower die either by providing the upper punch with a larger diameter or a suitable relief angle as will be set forth in more detail hereinafter, thereby assuring that the blank is fractured between its offset cut lines intermediate its top and bottom surfaces, rather than cut completely through. The larger cut opening also assures that the blank can be pushed upwardly freely from the stock by the lower punch itself, without contact with the stock to avoid snagging the blank periphery.

The resulting blank edge has a shiny upper peripheral burnished land portion and a shiny bottom peripheral burnished land portion separated by a rough intermediate peripheral portion where it is fractured, each of said portions being of substantially the same proportionate thickness of the entire thickness of the blank and, the blank is free of any burrs.

Once the periphery of the blank has been formed by the aforementioned process, the blank may be subjected to successive piercing operations or steps to form interior bores in a similar manner, resulting in a smooth, burr-free inner diameter bore.

BRIEF DESCRIPTION OF THE DRAWINGS

Further objects and advantages of the present invention will become apparent from the following description and claims, and from the accompanying drawings, wherein:

DETAILED DESCRIPTION OF THE PREFERRED EMBODIMENTS

Figure 1:
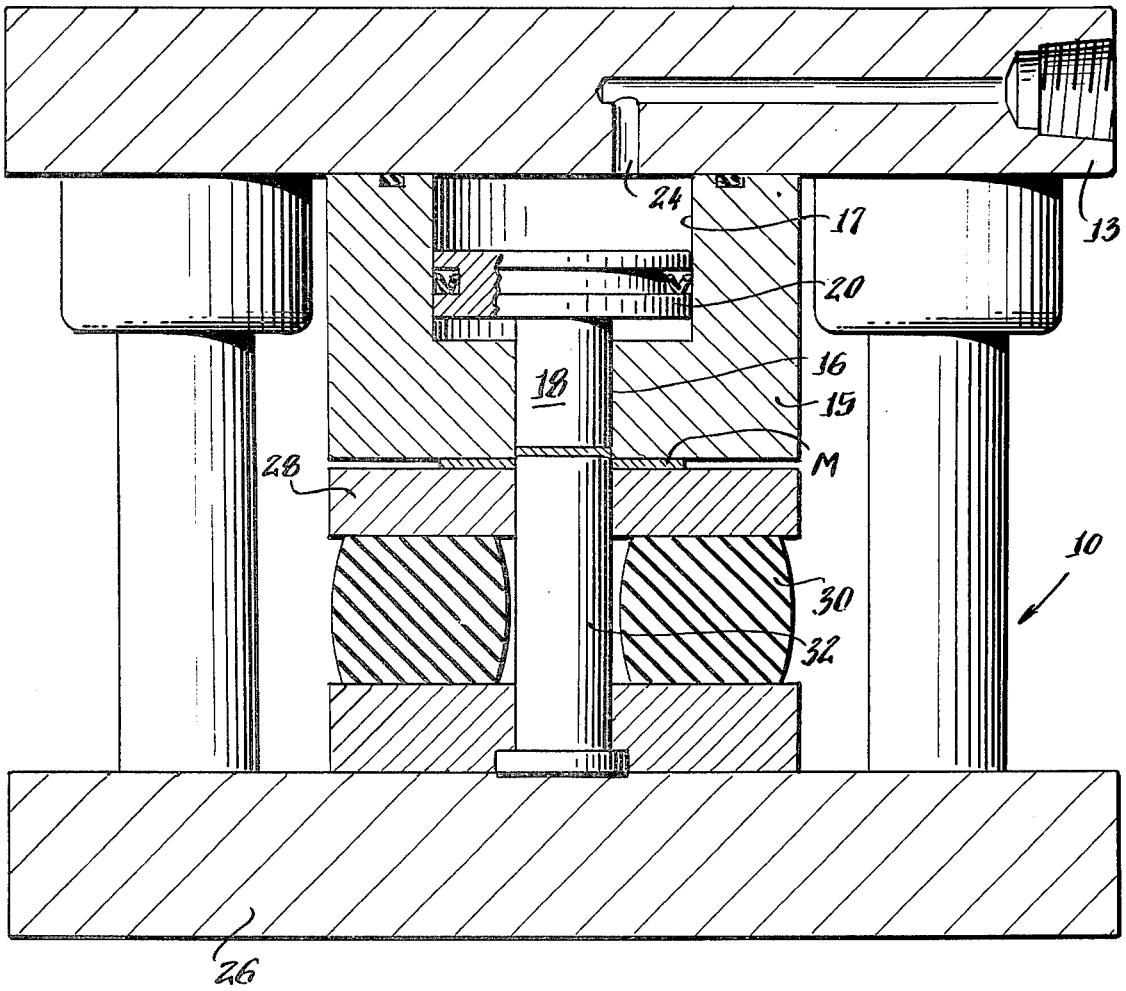
FIG. 1 is a sectional schematic diagram of an apparatus which can be used to perform the process of the present invention.

Referring now to the drawings in detail, wherein like numerals indicate like elements throughout the several views, apparatus 10 can be utilized in the method of the present invention to form a burr-free blank. The blank can be a washer B (FIGS. 6 and 7), having an outer peripheral edge 12 and a centrally located hole 14, although any one of a number of blank articles B can be formed utilizing the method, such as gears, seals, bearing retainers (cages), etc.

The apparatus 10 includes an upper die holder 13 which is movable vertically by mechanical or fluid pressure as is well known in the art. Connected to the upper die holder 13 is a die 15 having a bore 16 for receiving a punch 18 therethrough. The upper end 17 of the bore 16 has a larger diameter than the lower portion to slidably receive an annular ring extension 20 on the head of punch 18. The enlarged diameter bore portion 17 can be in communication with a source of fluid through a fluid conduit 24 in the upper die holder 13. The punch 18 is slidable in bore 16 and in larger bore 17 relative to die 15 as will be more readily apparent hereinafter.

A lower die holder 26 supports a resilient compressible bumper ring or spring 30. A die 28 is seated on ring 30 and surrounds a stationary lower punch 32 fixed to lower die holder 26.

Figure 3:
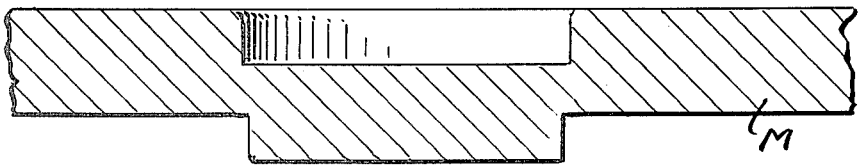
FIGS. 3 to 5, inclusive, are partial cross-sectional views illustrating successive steps in forming a burr-free blank in accordance with one embodiment of the process of the present invention.
Figure 4:
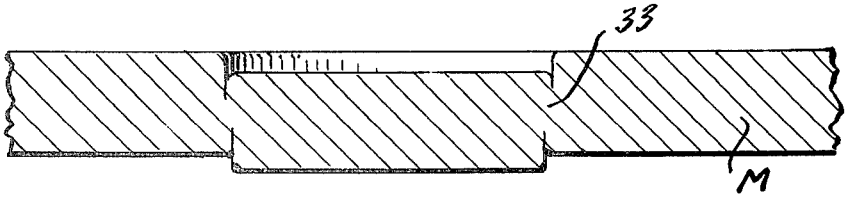

The initial work stroke of apparatus 10 to form a burr-free blank is acccomplished by feeding a sheet of flat metal stock M between the upper and lower dies 15 and 28 of apparatus 10 shown in FIG. 1. The upper die holder 13 is then moved downwardly and fluid pressure is also exerted on the ring 20 on top of punch 18 in large bore 17 through the admission of fluid through fluid conduit 24 to cause punch 18 to move downwardly to sever approximately 20%–60% of the thickness of the sheet metal stock M from the upper surface thereof depending upon the thickness and hardness of the stock material, and push the same downwardly past the lower edge of stock M as illustrated in enlarged detail in FIG. 3. The fluid pressure above punch 18 is then relieved and drained from conduit 24 while the upper die holder 13 continues to move downwardly causing die 15 to move downwardly relative to upper punch 18. The lower surface of upper die 15 contacts the upper surface of lower die 28 through stock M causing it to move downwardly compressing resilient bumper ring 30. The metal stock M will then be forced into bore 16 of die 15 by the upper portion of stationary punch 32 to sever less than the remaining uncut portion of the metal stock M from below, or the opposite surface thereof, to form the blank B, as illustrated in detail in FIG. 4. As shown in FIG. 4, the blank B is pushed upwardly by punch 32 until the metal fractures at 33, intermediate the top and bottom surfaces of stock M.

Figure 5:
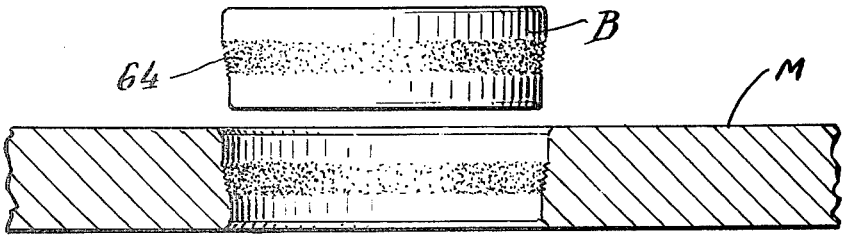

It has been found in accordance with one embodiment of the present invention that in order to effect control of the location of the partial fracture obtained through the present invention, upper punch on its initial partial downward stroke must create a cutting edge within the stock itself which acts, in essence, as a die. In order to accomplish this, it has been found necessary to maintain the diameter of the lower die 28 smaller than the diameter of the upper punch 18 by about 3 to 20% of the thickness of the metal stock, per side. Accordingly, the severed metal blank B will fracture intermediate the top and bottom cut portions at 33 and the blank B can then be pushed upwardly, as shown in FIG. 5, out of stock M by punch 32, without any contact of the bottom portion thereof with any edge of the stock M to cause any snags or burrs to be formed on blank B, except for portion 64 intermediate the ends thereof where it is fractured from stock M.

Figure 8:
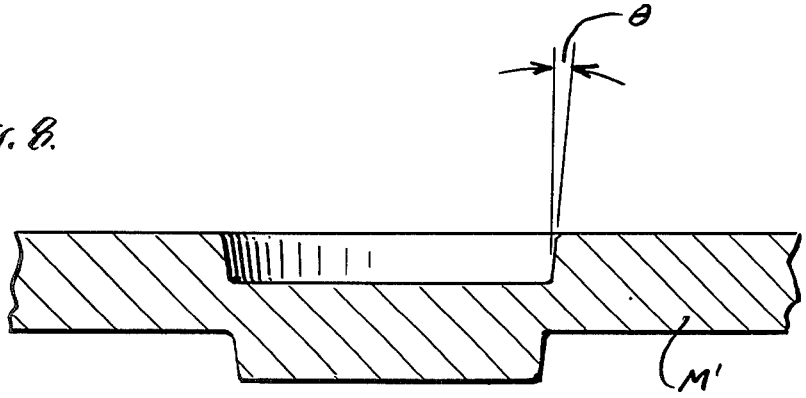
FIGS. 8 to 10, inclusive, are views similar to FIGS. 3 to 5, but illustrating successive steps in forming a burr-free blank in accordance with an alternate embodiment of the process of the present invention.
Figure 9:
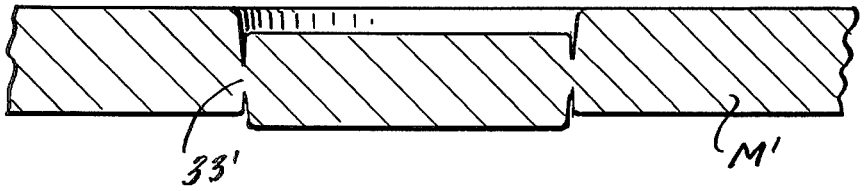
Figure 10:
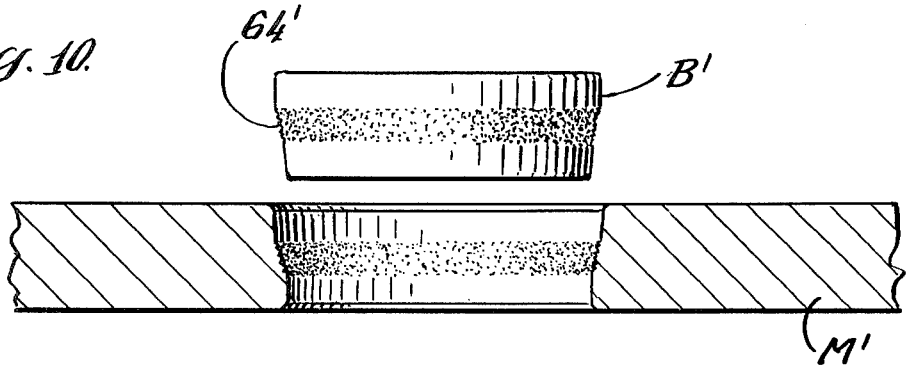

In an alternate and preferred embodiment, it has also been found possible to assure that the metal stock partially fractures, rather than is cut through, by forming the cutting surfaces of the lower die 28 and upper punch 18 at a relief angle $\theta$, (see, FIG. 8) of from about 1° to 15° from the vertical. The peripheral wall formed by the upper punch will then be inclined away from the blank at the relief angle $\theta$ and the lower burnished land portion formed by the lower die will be inclined toward the blank. As shown in FIGS. 8 to 10, wherein parts of the stock comparable to FIGS. 2 to 5 are indicated by prime letters and numbers, the stock M′ is partially punched through at an angle $\theta$ enabling the ultimate removal of the blank B′ from the stock M′ without any contact of the bottom portion thereof with any edge of the stock M' as it is pushed upwardly thereby reducing or eliminating the possibility of causing snags to form burrs. Further, since the blank B (or B') is separated from the stock M (or M') by breaking away from, rather than being cut therefrom by either punch, no portion of the blank B (or B') can be drawn axially about either punch to form a burr along the edge of blank B (or B').

Figure 2:
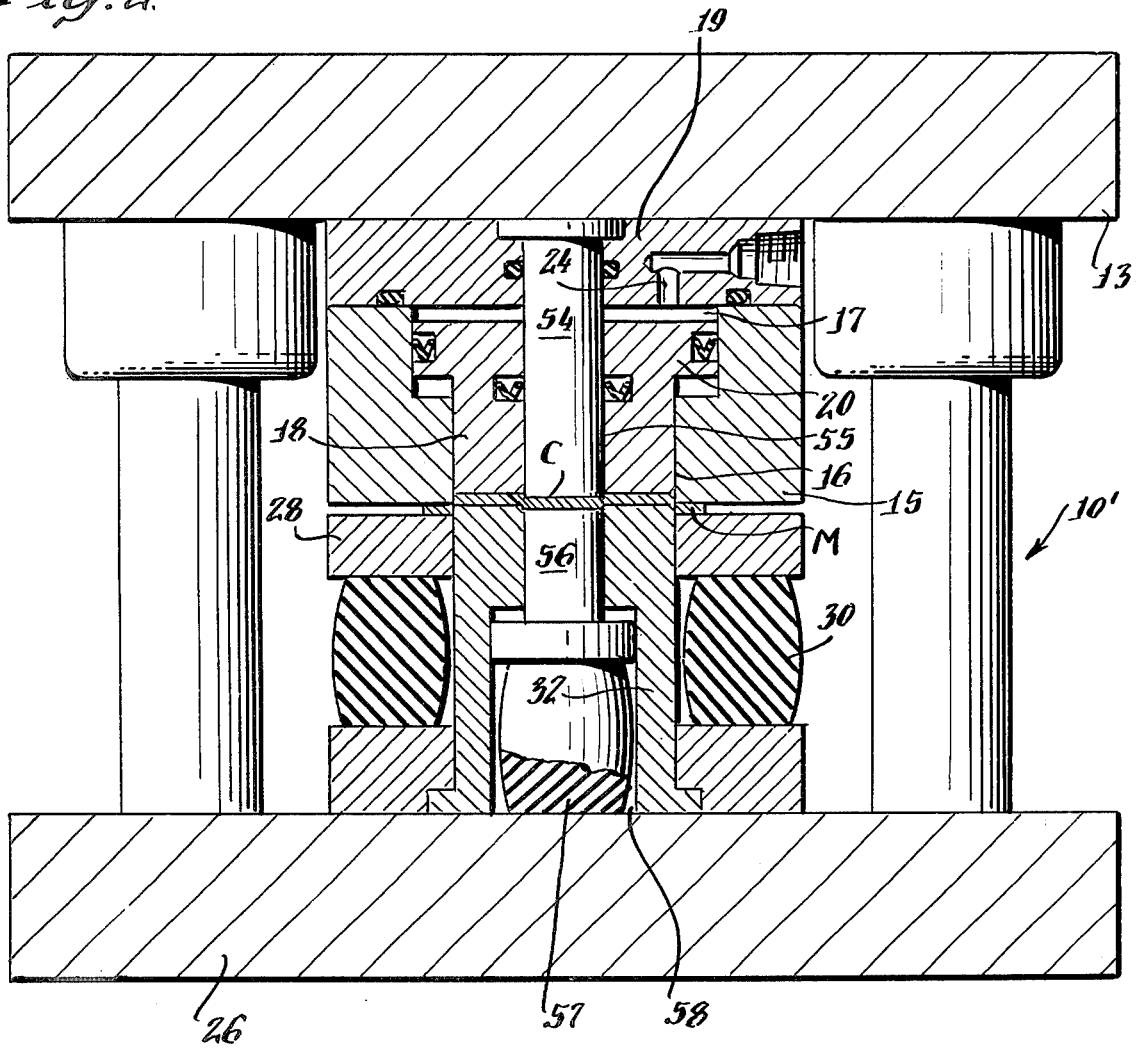
FIG. 2 is a view similar to FIG. 1, but illustrating an alternate form of an apparatus which can be used to form a burr-free inner diameter as well as a burr-free outer diameter.

Similar apparatus 10', illustrated in FIG. 2, can be used if it is desired that blank B have a burr-free inner diameter, or aperture 14, as well as a burr-free outer diameter. The outer diameter is formed as described above, the apparatus 10' employing the identical elements as apparatus 10, which are indicated by the same numerals. Apparatus 10' employs, however, an upper stationary punch 54 connected through punch holder 19 to die plate 13 and inserted through bore 55 of punch 16. A lower punch 56 mechanism is seated on a pre-loaded resilient and compressible cushion or spring 57 in a bore 58 in the interior or lower stationary punch 32. Punch 56, when contacted by a stock M cut by upper punch 54 moves downwardly in bore 58 compressing resilient cushion 57.

Upon the initial downward movement of the die plate 13 and punch 18 to from 20% to 60% of the thickness of the sheet metal stock of blank B, punch 56 will also sever blank B to a similar depth along a smaller diameter, from the lower surface of stock M, the punch 56 normally extending slightly above the upper edge of punch 32. Continued downward movement of die 15 to activate punch 32, will also cause punch 54, of slightly smaller diameter than punch 56, to sever the stock M from the upper surface thereof, fracturing and removing the center portion C from the resultant blank, intermediate the top and bottom surfaces of stock M, to form a burr-free interior opening 14. The removal of center portion C from stock M can be done progressively, if desired, rather than through the use of a compound die performing simultaneous severing of both an exterior and interior of the blank B.

Figure 6:
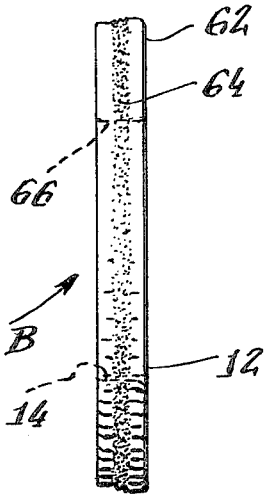
FIG. 6 is a side view in elevation of a blank formed by the apparatus of FIG. 2 in accordance with the successive process steps illustrated in FIGS. 3 to 5.
Figure 7:
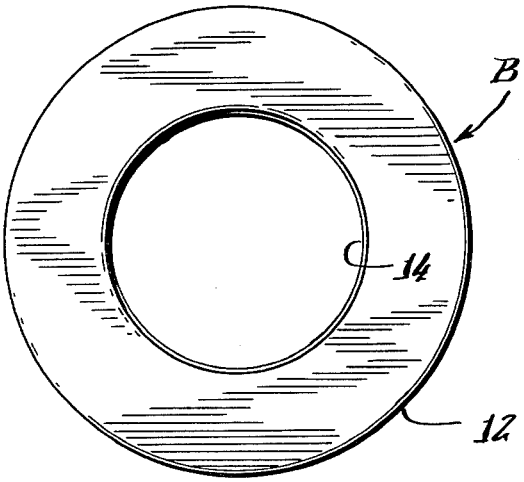
FIG. 7 is a top plan view of the blank of FIG. 6.

As shown in FIGS. 6 and 7 the resultant washer type blank B includes a peripheral edge 12 having an upper relatively shiny portion 62, a relatively shiny lower portion 66 of approximately equal width and a band or roughened middle portion 64 between the upper and lower portions 62 and 66 (as do all blanks formed by the method of the invention). All of the portions, however, are burr-free. The diameter of upper portion 62 is slightly greater than the diameter of lower portion 66. Similarly, opening 14 has shiny upper and lower portions, separated by a fracture band or a roughened portion, thereabout, all of which are burr-free.

Although the methods of the present invention have been disclosed primarily with reference to a compound die such as that disclosed in U.S. Pat. No. 3,878,746, these methods can also be effected employing a progressive die such as disclosed in U.S. Pat. No. 2,508,758 or, and perhaps most advantageously, transfer dies such as disclosed in U.S. Pat. Nos. 3,862,564 and 4,102,174.

What is claimed is:

1. A method for manufacturing a burr-free blank from an elongated sheet of flat metal stock comprising punching a first aperture in one surface of said metal stock, said first aperture extending only partially through said stock;

simultaneously forming a lower burnished land portion of said blank;

punching a second aperture in the opposite surface of said metal stock, coaxial with said first aperture, said second aperture extending only partially through said stock, said second aperture being smaller than said first aperture;

simultaneously forming an upper burnished land portion of said blank, causing the material of said stock to fracture between said burnished land portions and recovering said burr-free blank.

2. A method as defined in claim 1 wherein the diameter of the lower burnished land portion is smaller than the diameter of the first aperture by about 3 to 20% of the thickness of the metal stock per side.

3. A method as defined in claim 1 wherein the peripheral wall of the first aperture is inclined away from the blank at an angle of from about 1° to 15° from the vertical to provide clearance for the blank to pass thereacross and the peripheral wall of the lower burnished land portion is inclined toward the blank at an angle from about 1° to 15° from the vertical.

4. A method as defined in claim 1 wherein said first aperture extends to a depth of from about 20% to 60% of the thickness of the metal stock and said second aperture extends to a depth of less than the remaining thickness of said stock.

5. A method as defined in claim 1 additionally including the step of forming an interior burr-free bore in said blank by punching a third aperture in one surface of said blank spaced from the peripheral edge thereof, said third aperture extending only partially through said blank, simultaneously forming an upper burnished land portion of said bore, punching a fourth aperture in the opposite surface of said blank, coaxial with said third aperture, said fourth aperture extending only partially through said blank, said fourth aperture being smaller than said third aperture, simultaneously forming a lower burnished land portion of said bore, causing the material of said blank to fracture between said burnished land portions and recovering said blank containing an interior burr-free bore.

6. A method as defined in claim 5 wherein the diameter of the lower burnished land portion of said bore is larger than the diameter of the third aperture by about 3 to 20% of the thickness of the blank, per side.

7. A method as defined in claim 5 wherein the peripheral wall of the third aperture is inclined at an angle of from about 1° to 15° from the vertical and the peripheral wall of the lower burnished land portion of the bore is inclined at an angle of from about 1° to 15° from the verticle.

8. A method as defined in claim 5 wherein said third aperture extends to a depth of from about 20% to 60% of the thickness of the blank and said fourth aperture extends to a depth of less than the remaining thickness of said blank.

9. A burr-free metal blank exhibiting a shiny upper peripheral burnished land portion, a rough, fractured intermediate peripheral portion and a shiny lower peripheral burnished land portion, said lower land portion having a smaller circumference than said upper land portion.

10. A burr-free metal blank as defined in claim 9 additionally containing an interior burr-free bore spaced from the peripheral edge of said blank, said bore exhibiting a shiny upper peripheral burnished land portion, a rough, fractured intermediate peripheral portion and a shiny lower peripheral burnished land portion, said lower land portion having a larger circumference than said upper land portion.

* * * * *